US009181638B2

(12) United States Patent
Kwak

(10) Patent No.: US 9,181,638 B2
(45) Date of Patent: Nov. 10, 2015

(54) CONJUGATED FIBER HAVING EXCELLENT FLAME RETARDANCY AND COLOR FASTNESS AND INTERIOR FABRIC USING THE SAME

(75) Inventor: Dong Hun Kwak, Daegu (KR)

(73) Assignee: KOLON GLOTECH, INC., Gwacheon-Si (KR)

( * ) Notice: Subject to any disclaimer, the term of this patent is extended or adjusted under 35 U.S.C. 154(b) by 417 days.

(21) Appl. No.: 13/509,688

(22) PCT Filed: Mar. 24, 2010

(86) PCT No.: PCT/KR2010/001821

§ 371 (c)(1),
(2), (4) Date: Jul. 17, 2012

(87) PCT Pub. No.: WO2011/115320

PCT Pub. Date: Sep. 22, 2011

(65) Prior Publication Data

US 2012/0276360 A1 Nov. 1, 2012

(30) Foreign Application Priority Data

Mar. 15, 2010 (KR) ..... 10-2010-0023014

(51) Int. Cl.

| | |
|---|---|
| ***D04H 3/00*** | (2012.01) |
| ***D03D 13/00*** | (2006.01) |
| ***D01F 8/14*** | (2006.01) |
| ***D01F 8/16*** | (2006.01) |

(Continued)

(52) U.S. Cl.

CPC *D01F 8/14* (2013.01); *D01D 5/253* (2013.01); *D01F 1/10* (2013.01); *D01F 8/16* (2013.01); *Y10T 428/249921* (2015.04); *Y10T 428/2929* (2015.01)

(58) Field of Classification Search

CPC ..... D04H 1/541; D01F 8/04; D01F 8/14; D01F 1/02; D01F 1/07; D01F 1/10; D01D 5/253; D01D 5/30–5/34

USPC ..... 428/373–376, 920–921; 442/199–202, 442/361–364

See application file for complete search history.

(56) References Cited

U.S. PATENT DOCUMENTS

| | | | | |
|---|---|---|---|---|
| 5,019,445 | A * | 5/1991 | Sternlieb | 428/323 |
| 2002/0132546 | A1 * | 9/2002 | Yamanaka et al. | 442/400 |

(Continued)

FOREIGN PATENT DOCUMENTS

| | | | |
|---|---|---|---|
| JP | 2003-3333 | A | 1/2003 |
| JP | 2006-274504 | A | 10/2006 |

(Continued)

OTHER PUBLICATIONS

International Search Report for PCT/KR2010/001821 dated Apr. 26, 2011.

*Primary Examiner* — Jennifer A Steele
(74) *Attorney, Agent, or Firm* — Sughrue Mion, PLLC

(57) ABSTRACT

A conjugated fiber having excellent flame retardancy and color fastness and an interior fabric using the same are provided. According to the present invention, a sheath-core type conjugated fiber comprises a core component of polyphenylene sulfide resin and a sheath component of polyester-based resin. A sea-island type conjugated fiber comprises an island component of polyphenylene sulfide resin and a sea component of polyester-based resin.

8 Claims, 3 Drawing Sheets

(51) Int. Cl.
*D01D 5/253* (2006.01)
*D01F 1/10* (2006.01)

(56) References Cited

U.S. PATENT DOCUMENTS

2009/0156075 A1* 6/2009 Rollin et al. ..... 442/199
2010/0275568 A1* 11/2010 Chikatsune et al. ..... 57/247

FOREIGN PATENT DOCUMENTS

JP 2006-274504 * 12/2006 ..... D02G 3/02
KR 10-1993-0003368 B1 4/1993
KR 10-2007-0097618 A 10/2007
WO 91/10761 A1 7/1991
WO 02/40755 A2 5/2002

* cited by examiner

CONJUGATED FIBER HAVING EXCELLENT FLAME RETARDANCY AND COLOR FASTNESS AND INTERIOR FABRIC USING THE SAME

CROSS REFERENCE TO RELATED APPLICATIONS

This application is a National Stage of International Application No. PCT/KR2010/001821 filed Mar. 24, 2010, claiming priority based on Korean Patent Application No. 10-2010-0023014 filed Mar. 15, 2010, the contents of all of which are incorporated herein by reference in their entirety.

TECHNICAL FIELD

The present invention relates to conjugated fibers having excellent flame retardancy and color fastness and interior fabrics using the same. More specifically, the present invention relates to sheath-core type conjugated fibers and sea-island type conjugated fibers employing polyphenylene sulfide and interior fabrics using the same.

BACKGROUND ART

The markets for flame retardancy fibers have been huge and begun to pay attention to interior material for flame retardancy.

Synthetic fibers such as those formed of nylon, polyester, polypropylene and the like, because of being excellent in physical and chemical properties, find now wide applications in the form of clothing, curtain, carpet and other materials. However, these fibers are combustible; so they are required to have flame retardancy when applied to automotive trims, housing, etc.

Due to strong regulations in the field of fire service and environment, flame retardancy needs continuously become more demanding. In Japan, using flame retardancy fibers is legislated in infra-structures. In order to obtain approval, bed matrix, in particularly baby products, should be made of flame retardancy materials. Various products without eco-label could not enter into market throughout strict regulations of Europe.

In viewpoints of interior fiber materials for transportations (i.e., automotives, trains, ships, air transportations), flame retardant PET yarns (yarn contains flame retardancy agent in itself) or PET yarns performed by post flame retardancy finish have been employed in automotives. However, these do not meet required flame retardancy property and has a disadvantage of non friendly-environment. In trains, ships, air transportations, wool or acrylic fibers with excellent flame retardancy property have been adopted, and aramid fiber of high cost also adopted partly.

Whereas the interior materials for automotives only needs flammability (carbonization), those for trains, ships, and air transportations more require flammability (carbonization distance, glow time or LOI) as well as smoke density, toxic index. Therefore, it is very difficult for synthetic fibers such as PET, nylon and so forth to satisfy flame retardancy property, so that wool, acrylic fibers, or specialty fibers have been used Like this, the requirement of interior materials suitable for transportations and additional functions has been increased. Some issues to be considered in functions of interior materials are security for fire, that is, flame retardancy property.

Imparting flame retardancy to fibers is generally achieved by adding flame retardants to the starting polymers or post-treating fibers with flame retardants.

One difficulty in securing stable flame retardancy property comes from the limitation of the amount of flame additives and restriction of halogen flame retardancy agent. Flame retardancy process (adding flame retardants during spinning step or post-treating finish with flame retardants) induces the endurance and emotional quality (design).

Particularly, since most of automotive interior materials are bonded with polyurethane foam, it is necessary that high flame retardancy materials such as polyphenylene sulfide (LOI is 34) with excellent flame retardancy is used so as to reinforce and supplement composite materials.

Recently, flame retardancy needs continuously become more demanding in the field of interior materials for house service or construction. For these use, polyester fibers have been widely used in that they are easily controlled and have price competitiveness. In spite of these advantages, they do not satisfy high flame retardancy property, for example, over 30 LOI.

In order to reduce damages resulted from fire, there is a necessity of flame retardancy fibers, and fibers capable of imparting thermal stability, chemical resistivity, and dimensional stability to interior materials, flame retardancy materials, and sound absorbing materials, which become high-volume market.

Typical example of the above fiber is polyphenylene sulfide. Since the polyphenylene sulfide fiber has inherently more stable with respect to heat. Thus, it offers many advantages of excellent flame retardancy property, stability with respect to smoke density, and controlling toxic gas. In addition, it has continuous thermal stability, chemical resistivity, low absorption, dimensional stability, and chemical resistance and so forth. Unlike this, PET by post flame retardancy finish or fibers added with flame retardancy agent has a limitation of flame retardancy property, poor smoke density, and is not capable of controlling toxic gas.

Polyphenylene sulfide fibers have been known that they can be dyed with disperse dye. However, they tends to be limited to the application of back-filter, electronic components, and automotive components without requiring dyeing.

For replacing conventional interior materials and engineering fabrics by improving dyeing and color fastness of polyphenylene sulfide, this encourages the development of polyphenylene sulfide. In other words, the thermal stability of polyphenylene sulfide (LOI is 34) is already verified, but securing verification of the smoke density and toxic gas and control technique is needed in order to combine interior materials for air transportation and interior materials.

Meanwhile, the most important property next to flame retardancy property is vision characteristic to be used in interior materials. For instance, because construction materials such as curtains and interior materials for movable means such as automotives are exposed to light under severe environment (sunlight or UV) for a long time, color fastness is important factor in dyed products.

Polyphenylene sulfide fibers have excellent flame retardancy, thermal stability, and chemical resistance but a weak to sunlight. Also there is a problem that its color is changed into brown when exposed to sunlight at a high temperature for a long time.

Accordingly, it has been proposed that fibers have flame retardancy property, thermal stability as well as excellent dyeing and color fastness and interior fabric using the same.

DISCLOSURE

Technical Problem

The present invention has been made in an effort to solve the above problems, and it is an object of the present invention to provide a conjugated fiber having excellent flame retardancy and an interior fiber using the same.

It is another object of the present invention is to provide a conjugated fiber having excellent flame retardancy as well as dyeing property and color fastness.

It is still another object of the present invention is to provide an interior fabric for controlling smoke density and toxic gas and applicable to interior material of transportation means.

Technical Solution

Embodiments provide a conjugated fiber comprising a core component of polyphenylene sulfide resin and a sheath component of polyester-based resin.

Embodiments provide a conjugated fiber having excellent flame retardancy and color fastness comprising an island component of polyphenylene sulfide resin and a sea component of polyester-based resin.

In some embodiments, an area of the sheath component is 20% to 60% for entire area of the conjugated fiber.

In some embodiments, an area of the sea component is 20% to 60% for entire area of the conjugated fiber.

In some embodiments, the polyphenylene sulfide resin of 40 weight % to 80 weight % is contained and the polyester-based resin of 20 weight % to 60 weight % is contained.

In some embodiments, a cross section of the core component is circle, polygon, special characters (X, Y, and T) and irregular.

In some embodiments, a cross section of the island component is circular, oval, and multi-lobal.

In some embodiments, a yarn thickness of the conjugated fiber is 0.3 to 20 denier.

In some embodiments, a weight-average molecular weight of the polyphenylene sulfide is 35,000 to 80,000 and a melt viscosity of the polyphenylene sulfide is 1,000 to 3,500 poise at a temperature of 300° C.

In some embodiments, the polyester-based resin is at least one from the group consisting of polyethylene-terephthalate (PET), polybutylene-terephthalate (PBT), polytrimethylene-terephthalate (PTT), polyethylene-terephthalate (PEN), polyethylene-terephthalate glycol (PETG), and poly-cyclohexane-dimethylene-terephthalate (PCT).

In some embodiments, at least one Titanium dioxide ($TiO_2$), Zinc oxide (ZnO), Silicon dioxide ($SiO_2$), Kaoline is mixed with the polyester-based resin, and Titanium dioxide ($TiO_2$), Zinc oxide (ZnO), Silicon dioxide ($SiO_2$), Kaoline are mixed in an amount of 0.1 to 10.0 part by weight based on 100 parts by weight of the polyester-based resin.

In some embodiments, an interior fabric is provided using the conjugated fiber.

In some embodiments, the interior fabric is applicable to interior materials of transportation means.

Advantageous Effects

The conjugated fiber according to the embodiments of the present invention have excellent flame retardancy, dyeing property, and color fastness.

Additionally, the conjugated fiber according to the embodiments of the present invention is capable of controlling smoke density and toxic gas to be applicable to interior materials of transportation means.

Furthermore, the conjugated fiber according to the embodiments of the present invention is capable of controlling color fastness, smoke density and toxic gas to engage high textiles (i.e., Aramid fibers, carbon fibers, PBO) with universal textiles (i.e., PET, nylon, polypropylene)

BEST MODE

Figure 1:
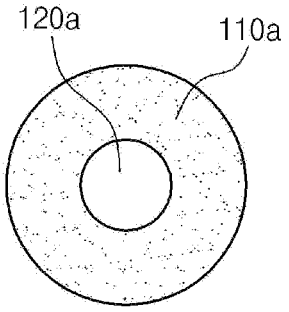
FIGS. 1 to 4 are cross-sectional view of a sheath-core type conjugated fiber according to an embodiment.

Preferred embodiments of the present invention will now be described in detail with reference to the accompanying drawings. It should be noted that whenever possible, the same reference numerals will be used throughout the drawings and the description to refer to the same or like parts. In describing the present invention, detailed descriptions of related known functions or configurations are omitted in order to avoid making the essential subject of the invention unclear.

As used herein, the terms "about", "substantially", etc. are intended to allow some leeway in mathematical exactness to account for tolerances that are acceptable in the trade and to prevent any unconscientious violator from unduly taking advantage of the disclosure in which exact or absolute numerical values are given so as to help understand the invention.

A conjugated fiber according to the present invention comprises a core component of polyphenylene sulfide resin and a sheath component of polyester-based resin.

A conjugated fiber according to the present invention comprises an island component of polyphenylene sulfide resin and a sea component of polyester-based resin.

In the sheath-core type conjugated fiber, it is preferable that an area of the sheath component is 20% to 60% for entire area of the conjugated fiber. In the event that the area of the sheath component is less than 20% for the entire area of the conjugated fiber, the core component is one-sided on fabrics or protruded from surface of fabrics. As a result, UV light causes yellowing in polyphenylene sulfide fibers. Also, it is preferable that a yarn thickness of the sheath-core type conjugated fiber is 0.3 to 20 denier.

In case that the area of the sheath component exceeds 60% for the entire area of the conjugated fiber, it is more difficult for the core component to have a location in a central axis of fibers. A relatively small amount of polyphenylene sulfide is occupied in the core component, so that this causes a difficulty in securing flame retardancy.

Additionally, it is preferable that the polyphenylene sulfide resin of 40 weight % to 80 weight % is contained and the polyester-based resin of 20 weight % to 60 weight % is contained in the sheath-core type conjugated fiber or the sea-island type fiber.

The nature of polyphenylene sulfide resin has excellent flame retardancy and therefore, a conjugated fiber containing polyphenylene sulfide resin also has excellent flame retardancy. However, the polyphenylene sulfide resin has some inherent problems such that its color is changed when it is exposed on light. In the conjugated fiber according to the present invention, polyester-based resin is formed in the outside of the polyphenylene sulfide resin to protect it from light. Resultantly, the color is not changed in the conjugated fiber.

Polyester-based resin performs a role in reducing an amount of UV light touched in polyphenylene sulfide as well as suppressing color-changing (yellowing) of polyphenylene sulfide by surface oxidation. Accordingly, color fastness becomes improved. Each of cross-section shapes of the sheath and core components is not limited. In other words, various shapes such as polygon (circle, triangle, pentagon etc), special characters such X, Y, T etc and irregular cross section can be employed. Despite these shapes, the core component should not protrude from surfaces of fibers.

In the above sheath-core type conjugated fiber, the cross section of the sheath and core components is not circle but polygon or irregular has more effect to improve color fastness.

FIGS. 1 to 4 are cross-sectional view of a sheath-core type conjugated fiber according to an embodiment.

Figure 2:
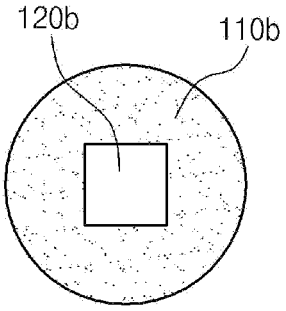
Figure 3:
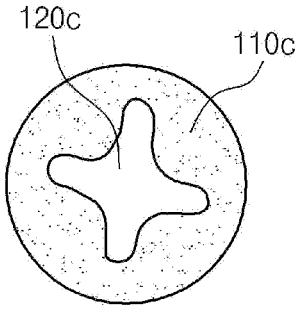

Referring to FIG. 1, a core component 120*a* and a sheath component 110*a* are formed. The shape of them is circle, respectively. In FIG. 2, whereas the shape of a sheath component 110*b* is circle, the shape of a core component 120*b* is quadrangle. Referring to FIG. 3, the shape of a core component 120*c* is irregular, so that color fastness becomes improved due to diffused reflection when light reaches the core component. Also, in FIG. 4, a large amount of light is not reached to the core component 120*d* formed with polyphenylene resin due to diffused refection on a surface of the sheath component because the shape of the sheath component 110*d* is irregular. This causes improvement of color fastness in the sheath-core type conjugated fiber.

Meanwhile, in the sea-island type conjugated fiber, the cross-section of the sea-island type conjugated fiber is also various such as polygon (i.e., circle, oval, triangle, quadrangle) and multi-lobal. Similarly, the cross-section of island can have various shapes like the above-mentioned shapes.

Figure 5:
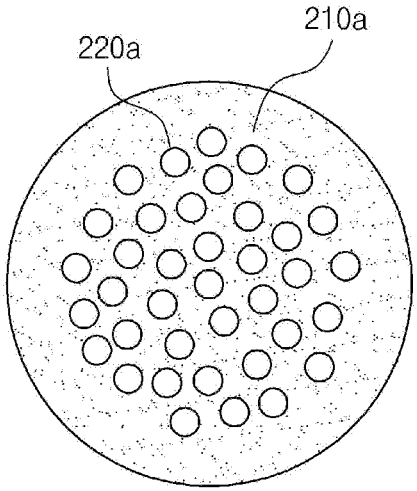
FIGS. 5 to 7 are cross-sectional view of a sea-island type conjugated fiber according to an embodiment.
Figure 6:
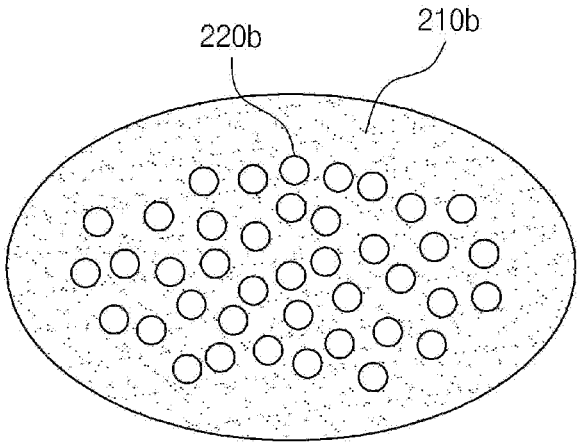
Figure 7:
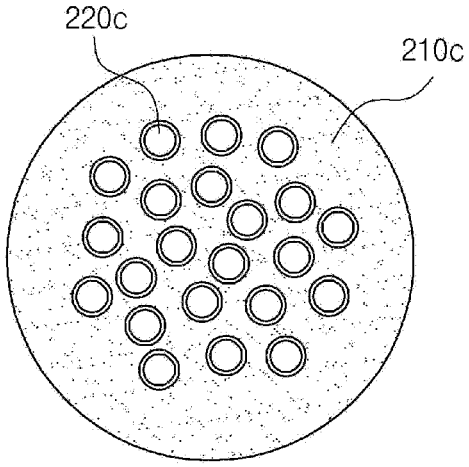

FIGS. 5 to 7 are cross-sectional view of a sea-island type conjugated fiber according to an embodiment. As shown in FIGS. 5 to 7, the shape, size, number, and arrangement of the island can be controlled. Referring to FIG. 5, circular island component 220*a* is divided by the sea component 210*a*. Referring to FIG. 6, the shape of the sea-island type conjugated fiber is oval. In order to minimize the contact of light with the island component, as shown in FIG. 7, a predetermined distance is maintained space between the island component 220*c* and the sea component 210*c*.

It is not necessary for the island component to have the same size. As not shown, sea-island type conjugated fiber may comprise an island component having different cross-section size. The cross-section of one island component may have a relatively size than that of the other island component. The island component may be more than one group having different size.

Preferably, several island components are arranged in the sea-island conjugated fiber. Since the island component is formed so as to prevent it from being directly in contact with light, it is preferable that it is concentrated in a center of the sea-island type conjugated fiber (See FIGS. 5 to 7).

Preferably, an area of the sea component is 20% to 60% for entire area of the sea-island type conjugated fiber. A yarn thickness of the sea-island type conjugated fiber is 0.3 to 20 denier.

A weight-average molecular weight of the polyphenylene sulfide is 35,000 to 80,000 and a melt viscosity of the polyphenylene sulfide is 1,000 to 3,500 poise (shear rate 400 $S^{-1}$) at a temperature of 300° C. Within the above range, a conjugated fiber is easily formed, and the inherent nature of polyphenylene sulfide such as flame retardancy, chemical resistivity is maintained.

The polyester-based resin consists of polyester, copolymer polyester, or blend thereof. The polyester-based resin is formed via condensation polymerization or copolymerization of diacid and diol. The polyester-based resin is at least one from the group consisting of polyethylene-terephthalate (PET), polybutylene-terephthalate (PBT), polytrimethylene-terephthalate (PTT), polyethylene-terephthalate (PEN), polyethylene-terephthalate glycol (PETG), and poly-cyclohexane-dimethylene-terephthalate (PCT).

Additionally, at least one Titanium dioxide ($TiO_2$), Zinc oxide (ZnO), Silicon dioxide ($SiO_2$), Kaoline is mixed with the polyester-based resin, and Titanium dioxide ($TiO_2$), Zinc oxide (ZnO), Silicon dioxide ($SiO_2$), Kaoline are mixed with the polyester-based resin. UV protection can be improved by mixing Titanium dioxide ($TiO_2$), Zinc oxide (ZnO), Silicon dioxide ($SiO_2$), Kaoline is mixed with the polyester-based resin, and Titanium dioxide ($TiO_2$), Zinc oxide (ZnO), Silicon dioxide ($SiO_2$), Kaoline in an amount of 0.1 to 10.0 part by weight based on 100 parts by weight of the polyester-based resin.

In order to control color degree and proper sense of weight, metallic oxidr can be added. Furthermore, additive (i.e., heat stabilizer and antioxidant) for reinforcing property can be mixed together.

The conjugated fiber in accordance with the present invention has excellent flame retardancy, dyeing property, chemical resistance, and color fastness. And, the conjugated fiber is capable of controlling smoke density and toxic gas to be applicable to interior materials of transportation means.

MODE FOR INVENTION

Reference will be made in detail to the preferred embodiments of the present invention. It is to be understood that the following examples are illustrative only and the present invention is not limited thereto. In the following examples and comparative examples, FDY and DTY of 150D/24F (150 Denier/24 Filament) are used. FDY is applied to double raschel mesh yarn. In a double raschel pile fabric, DTY is used as a pile yarn, and FDY is used as a ground yarn.

EXAMPLES

Example 1

A sheath-core type conjugated fiber comprising a core component of polyphenylene sulfide resin and a sheath component of polyester-based resin was formed. Polyphenylene sulfide resin was not exposed to the outside. The polyphenylene sulfide resin of 40 weight % was contained and the polyester-based resin of 60 weight % was contained. The shape of the sheath and core components was circle, respectively. A double raschel mesh fabric and a double raschel pile fabric were fabricated using the conjugated fiber and then their properties were measured.

Example 2

Example 1 is repeated to obtain the sheath-core type conjugated fiber comprising polyphenylene sulfide resin of 80 weight % and polyethylene-terephthalate of 20 weight %, except that the sheath component has a circular shape and the core component has an irregular shape as shown in FIG. 3.

Example 3

Figure 4:
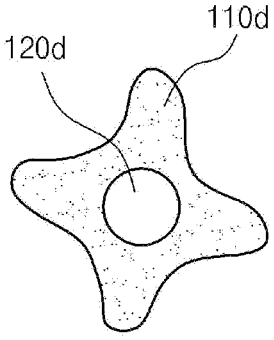

Example 1 is repeated to obtain the sheath-core type conjugated fiber comprising polyphenylene sulfide resin of 80 weight % and polyethylene-terephthalate (PET) of 20 weight %, except that the sheath component has an irregular shape and the core component has a circular shape as shown in FIG. 4.

Example 4

Example 1 is repeated to obtain the sheath-core type conjugated fiber, except that the core component contains polyphenylene sulfide resin of 60 weight % and the sheath component contains polyethylene-terephthalate (PEN) of 40 weight %, as shown in FIG. 1.

Example 5

Example 4 is repeated to obtain the sheath-core type conjugated fiber except that the Titanium dioxide ($TiO_2$) was mixed in an amount of 0.1 to 10.0 part by weight based on 100 parts by weight of the polyethylene-terephthalate (PEN).

Example 6

A sea-island type conjugated fiber comprising a sea component of polyphenylene sulfide resin and an island component of polyethylene-terephthalate (PEN) was formed. Polyphenylene sulfide resin was not exposed to the outside. The polyphenylene sulfide resin of 60 weight % was contained and the polyethylene-terephthalate (PEN) of 40 weight % was contained, as shown in FIG. 5. The shape of the sea and island components were circle, respectively. A double raschel mesh fabric and a double raschel pile fabric were fabricated using the conjugated fiber and then their properties were measured.

Example 7

Example 6 is repeated to obtain the sea-island type conjugated fiber comprising polyphenylene sulfide resin of 50 weight % and the polyethylene-terephthalate (PEN) of 50 weight %, as shown in FIG. 6.

Comparative Example 1

A single fiber was fabricated using the polyphenylene sulfide resin used in the example 1. A double raschel mesh fabric and a double raschel pile fabric were fabricated using the single fiber and then their properties were measured.

Comparative Example 2

A sheath-core type conjugated fiber comprising a core component of polyethylene-terephthalate (PET) and a sheath component of polyphenylene sulfide resin was formed. The polyethylene-terephthalate (PET) of 40 weight % and the polyphenylene sulfide resin of 60 weight % was contained. The shape of the sheath and core components was circle, respectively. A double raschel mesh fabric and a double raschel pile fabric were fabricated using the conjugated fiber and then their properties were measured.

Comparative Example 3

A single fiber was fabricated using the polyethylene-terephthalate (PET). A double raschel mesh fabric and a double raschel pile fabric were fabricated using the single fiber and then their properties were measured.

Measurement Methods

1. Dyeing Experiment
(1) Double Raschel Mesh Fabric
Dyeing Condition:
- Dyeing Temperature Range: 130° C.
- Dyeing Period: 70 min
- Dyeing Ratio: 1:29.9
- Dyeing Concentration: 6.532 o.w.f
- Dyeing Composition: Synolon Yellow AK (2.0%), Synolon Red AK (1.129%), Synolon Blue AK (0.888%), Kayalon Black FAL (2.515%)
- Dyeing Auxiliaries: Dispersing agent (Sunsolt RM-340, 0.25 g/l), pH regulator (KF-ACID PH-35, 0.25 g/l), Light fastness agent (LPS-9900, 4%)

(2) Double Raschel Mesh Fabric
Dyeing Condition:
- Dyeing Temperature Range: 130° C.
- Dyeing Period: 70 min
- Dyeing Ratio: 1:18
- Dyeing Concentration: 3 o.w.f
- Dyeing Composition: Synolon Yellow AK (0.15%), Synolon Red AK (0.55%), Synolon Blue AK (2.3%)
- Dyeing Auxiliaries: Dispersing agent (Sunsolt RM-340, 0.25 g/l), pH regulator (KF-ACID PH-35, 0.25 g/l), Light fastness agent (LPS-9900, 4%)

2. Dyeing Exhaustion Concentration
Surface reflectance was measured at maximum absorption wavelength of dyed fabrics using spectro-photometer (X-Rite, Model SP-B8, U.S.A). Dyeing exhaustion concentration (K/S) was calculated in accordance with Kubelka-Munk Formula. The dyeing exhaustion concentration of the dyed fabrics was compared depending on conditions.

$$K/S=(1-R)^2\div(2R)$$

(where, K means absorption coefficient, S means scattering coefficient, and R means reflectance.)

3. Color Fastness Experiment
Color fastness was measured based on KS K ISO 105-B02.

4. Limiting Oxygen Index (LOI)
Limiting oxygen index was measured based on ISO 4589-2.

5. Smoke Density
Smoke density was measured based on KS M ISO 5659-2 (according to flamming mode). Under the condition that radiation of 25K w/m$^2$ was provided, a flare type burner with flame length of 30 mm was employed. Also, smoke density was measured at 1.5 minutes or 4.0 minutes.

6. Toxic Index
Toxic Index was measured based on BS 6853 Annex B.2. After analyzing content by elements with respect to eight kinds of gases in horizontal firing applications of a smoke density tester, and then convert them.

7. Fabric Weight
Fabric weight was measured based on KS K 0514.

8. MS Flammibility
MS flammability was measured based on MS 3008-08 of Hyundai-kia motors.

A sample was fixed in "⊔" shaped sample fixture. Then, flame of a burner was applied to an end of the sample during 15 seconds and then remove it. By measuring flame combustion and time, MS flammability was evaluated by a burning rate (SE: Self Extinguish)

Measurement Result

1. Double raschel mesh fabric

TABLE 1

| Classification | Dyeing exhaustion concentration (K/S) | Color fastness | Organic Volatilty (ppm) Formalin | t-VOC | MS Flammability |
|---|---|---|---|---|---|
| Example 1 | 16.5 | 3.0 | 0.9 | 4.1 | SE |
| Example 2 | 14.2 | 2.5 | 0.7 | 3.6 | SE |
| Example 3 | 15.4 | 2.0 | 0.7 | 3.3 | SE |
| Example 4 | 17.2 | 3.0 | 0.6 | 3.2 | SE |
| Example 5 | 16.8 | 3.5 | 0.6 | 3.0 | SE |
| Example 6 | 16.9 | 2.5 | 0.8 | 3.8 | SE |
| Example 7 | 17.4 | 3.0 | 0.9 | 4.0 | SE |
| Comparative Example 1 | 1.8 | 1.0 | 0.5 | 2.8 | SE |
| Comparative Example 2 | 2.2 | 1.0 | 0.8 | 4.2 | SE |
| Comparative Example 3 | 20.4 | 4.0 | 2.0 | 12.1 | Failure (255 mm/min) |

TABLE 2

| Classification | Dyeing exhaustion concentration (K/S) | Color fastness | LOI | Flamming Mode De (1.5 min) | De (4 min) | Toxic Index |
|---|---|---|---|---|---|---|
| Example 1 | 56.5 | 2.5 | 32 | 31 | 62 | 0.55 |
| Example 2 | 47.4 | 2.0 | 41 | 19 | 43 | 0.48 |
| Example 3 | 44.1 | 2.0 | 40 | 18 | 41 | 0.45 |
| Example 4 | 48.0 | 2.5 | 39 | 22 | 48 | 0.50 |
| Example 5 | 47.5 | 3.0 | 40 | 20 | 44 | 0.48 |
| Example 6 | 50.6 | 2.5 | 35 | 23 | 50 | 0.51 |
| Example 7 | 52.0 | 3.0 | 37 | 28 | 54 | 0.53 |
| Comparative Example 1 | 9.3 | 1.0 | 47 | 6 | 15 | 0.41 |
| Comparative Example 2 | 22.3 | 1.0 | 36 | 31 | 60 | 0.53 |
| Comparative Example 3 | 63.0 | 4.0 | 21 | 115 | 382 | 3.20 |

Results

As a result, it could be seen that the mesh and pile fabrics of the examples 1 to 6 had higher dyeing exhaustion concentration than those of the comparative examples 1 and 2. It could be found that the fiber and fabrics using the same according to the present invention had excellent dyeing property.

In addition, as illustrated in the examples 1 to 6, the color fastness of the fibers is 2.0 to 3.5 grades. This means that the shortcomings of polyphenylene sulfide such as poor color fastness are remedied.

With respect to the smoke density, the fabrics of the examples 1 to 6 are dramatically lower than the polyester-based fiber of the comparative example 3, so that it could be seen that the fabrics of the examples 1 to 6 significantly reduce the fire risk and any flames that result are specifically suppressed. Also, throughout the limiting oxygen index over 35, it could be seen that they had flame retardancy.

In terms of organic volatility and toxic index, there are the fabrics of the examples 1 to 6 less released toxic gas when they burned.

The conjugated fiber and the fibers using the same have excellent flame retardancy as well as dyeing property and color fastness.

Although the present invention has been described herein with reference to the foregoing embodiments and the accompanying drawings, the scope of the present invention is defined by the claims that follow. Accordingly, those skilled in the art will appreciate that various substitutions, modifications and changes are possible, without departing from the spirit of the present invention as disclosed in the accompanying claims. It is to be understood that such substitutions, modifications and changes are within the scope of the present invention.

The invention claimed is:

1. A conjugated fiber having excellent flame retardancy and color fastness comprising an island component of polyphenylene sulfide resin and a sea component of polyester-based resin, wherein and the island component and the sea component are spaced apart, by a space enclosing the island component wherein at least one of Zinc oxide (ZnO), Silicon dioxide ($SiO_2$), Kaoline is mixed with the polyester-based resin, and wherein Zinc oxide (ZnO), Silicon dioxide ($SiO_2$), Kaoline are mixed in an amount of 0.1 to 10.0 part by weight based on 100 parts by weight of the polyester-based resin.

2. The conjugated fiber according to claim 1, wherein an area of the sea component is 20% to 60% for entire area of the conjugated fiber.

3. The conjugated fiber according to claim 1, wherein a cross section of the island component is circular, oval, and multi-lobal.

4. The conjugated fiber according to claim 1, wherein the fiber comprises the polyphenylene sulfide resin of 40 weight % to 80 weight % and the polyester-based resin of 20 weight % to 60 weight %.

5. The conjugated fiber according to claim 1, wherein a yarn thickness of the conjugated fiber is 0.3 to 20 denier.

6. The conjugated fiber according to claim 1, wherein a weight-average molecular weight of the polyphenylene sulfide is 35,000 to 80,000 and a melt viscosity of the polyphenylene sulfide is 1,000 to 3,500 poise at a temperature of 300° C.

7. The conjugated fiber according to claim 1, wherein the polyester-based resin is at least one from the group consisting of polyethylene-terephthalate (PET), polybutylene-terephthalate (PBT), polytrimethylene-terephthalate (PTT), polyethylene-terephthalate (PEN), polyethylene-terephthalate glycol (PETG), and poly-cyclohexane-dimethylene-terephthalate (PCT).

8. An interior fabric using the conjugated fiber according to claim 1.

* * * * *